United States Patent [19]

Hall

[11] 4,328,865

[45] May 11, 1982

[54] WAX CONTROL IN OIL WELLS USING A THERMAL SYPHON SYSTEM

[75] Inventor: Edward N. Hall, Rolling Hills Estates, Calif.

[73] Assignee: Chromalloy American Corporation, St. Louis, Mo.

[21] Appl. No.: 177,398

[22] Filed: Aug. 12, 1980

[51] Int. Cl.[3] ..... E21B 37/00; E21B 43/24

[52] U.S. Cl. ..... 166/302; 166/304; 166/61

[58] Field of Search ..... 166/302, 304, 60, 61, 166/57, 191, 64, 113

[56] References Cited

U.S. PATENT DOCUMENTS

| | | | |
|---|---|---|---|
| 2,300,348 | 10/1942 | Dana | 166/302 |
| 2,379,138 | 6/1945 | Fitting, Jr. et al. | 166/191 X |
| 2,530,280 | 11/1950 | Ackley | 166/60 X |
| 2,644,531 | 7/1953 | McLean | 166/60 X |
| 2,770,307 | 11/1956 | Deerdoff | 166/302 |
| 3,014,531 | 12/1961 | Weaver | 166/302 |
| 3,213,942 | 10/1965 | Nixon | 166/60 |
| 3,459,264 | 8/1969 | Olson et al. | 166/191 X |
| 3,908,763 | 9/1975 | Chapman | 166/304 X |

*Primary Examiner*—Stephen J. Novosad
*Attorney, Agent, or Firm*—Haverstock, Garrett & Roberts

[57] ABSTRACT

This invention relates to a system for controlling wax formation in oil wells using a thermal syphon wherein a confined annular space between the production tube and the oil string casing is provided by means of a plug, or "packer", installed at a point well below the level at which solid waxes begin to deposit out of the exiting crude oil and a plug, or "packer", installed above the point at which waxes would otherwise stop depositing out of the exiting crude oil and thereafter filling the confined annulus with a fluid working medium. The quantity and properties of the fluid working medium are arranged such that the medium is vaporized at the lower extremeties of the confined annulus and condensed on the surfaces of the upper regions of the confined annulus, particularly in the zone of wax deposition. The condensation process warms the production tube sufficiently to prevent formation of adhesive wax deposits or, alternatively, reliquifies a thin film of deposited wax which enables the flowing crude oil to remove the deposited wax. The condensed working medium flows by gravity to the lower part of the confined annulus where it again becomes available for vaporization and subsequent condensation. No external power is used for this circulation which is caused solely by temperature differences between lower and higher levels of the annulus.

14 Claims, 2 Drawing Figures

WAX CONTROL IN OIL WELLS USING A THERMAL SYPHON SYSTEM

BACKGROUND OF THE INVENTION

Oil being pumped from deep wells is quite warm and often contains wax compositions and various gases intermixed with the crude oil. As the oil is being pumped from deep in the ground to the surface, the oil is cooled by evolution and expansion of dissolved gases so that the waxes are cooled enough to deposit out onto the inner surface of the production tube through which the oil is exiting. The wax deposits on the inner surface of the oil well production tube in a reasonably well-defined zone. Deposition of the waxes ends at the point where sufficient gas has evolved to permit the wax deposition rate to drop below the value required to resist the scouring action of the flowing oil. Thus the process of wax deposition and build-up is reasonably stable. This waxing problem can be so serious as to substantially plug the production tube requiring shut down of the well, pulling of the pump plunger and physically removing the wax by mechanical brushing. Obviously, this is very expensive and output is reduced.

Oil wells have an inner pipe, or production tube, generally of steel, through which the oil exits and oil wells generally have a casing, or "oil string", surrounding the production tube, which is generally made of steel and which generally reaches down to the oil-bearing earth structure. There is thus provided annular space between the production tube through which the oil exits and the oil string casing.

It is the purpose of the invention to use the existing annulus, described above, thermal gradients along the length of the well, and a selected working fluid to prevent the deposition of wax on a continuous, self-controlled, basis.

PRIOR ART

The problem of wax deposition in oil wells has been recognized for a long time. Generally, means have been suggested to heat the exiting crude oil in order to keep the wax liquified. One such process is discussed in U.S. Pat. No. 3,908,763 which discloses a method of maintaining the flow of paraffin-containing crude oil by maintaining the temperature above the melting temperature of the paraffin so that the paraffin is dissolved and re-absorbed in the crude oil and carried in a fluid state in the crude oil as it flows from the well. Heating is accomplished by conducting a heating oil through a conducting loop line extending from the top of the well to the bottom of the well then back to the top of the well to form a loop whereby essentially the entire well structure is maintained at a temperature below the fracturing temperature of the oil and the paraffin and above the oil chill temperature where the paraffin separates from the oil. The apparatus used to heat the heating oil is a closed loop steam system wherein the heating oil is heated in a tank by steam generated by a heater. The disadvantages of this system derive from the requirement for heating large amounts of crude oil. Contrasted to this, the present invention provides a system whereby only a very small energy input is required to heat the thin layer of wax near the inner surface of the production tube and therafter letting the exiting oil physically remove the wax deposits. Moreover, the heat to operate the thermal syphon is provided by the oil approaching and entering the production tube at its base. Temperatures at this depth are many degrees warmer than those characterizing the wax deposit zone of the production tube. Oil entering this tube conveys heat from the surrounding rock to the production tube, heating the thermal syphon working medium in the lower regions of the annulus, thus vaporizing liquid which has previously condensed in the wax deposit zone, giving up heat and melting the wax at the steel-wax interface.

OBJECTS OF THE INVENTION

It is an object of this invention to maintain the flow of wax-containing crude oils in a well structure by heating the outer surface of the production tube to melt a thin layer of deposited wax in order that the wax deposits may be physically removed by the exiting crude oil.

It is another object of this invention to provide an oil well structure having an inner well tube and an outer well casing with an annular space in between which is plugged at or near the lower extremity and at a point above which wax ceases to be deposited out of the exiting oil.

It is a further object of this invention to use the known physical characteristics of a fluid working medium which is maintained at such a pressure that it will volatilize at temperatures associated with the section of oil production tube exterior below the wax deposit zone and condense at temperatures characterizing the exterior surface of the production tube in the wax deposit zone. Thus, with no addition of energy for pumping or heat, this working medium will transfer heat from the deep rocks to the wax deposit zone, preventing the wax from adhering to the inner production tube surface.

BRIEF DESCRIPTION OF THE INVENTION

Figure 1:
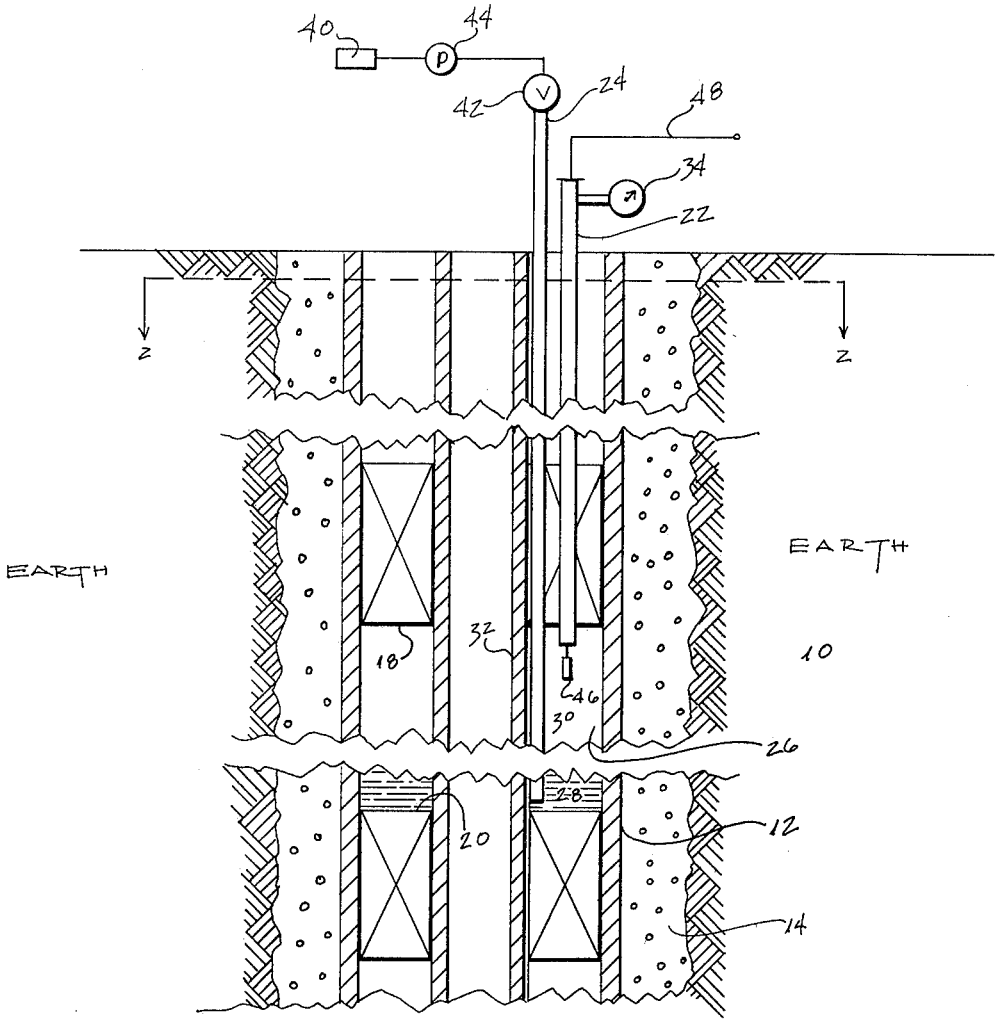
FIG. 1 is a sectioned elevational view of the invention in an oil well.

This invention uses a thermal syphon to control the deposition of wax on the inner surface of the production tube through which crude oil exits by warming the outer surface of the tube sufficiently throughout the length of the defined zone where the wax deposition normally occurs to create a liquid film immediately adjacent to the inner surface of the production tube which results either in formed wax deposits being removed by the flow of oil from the well or prevention of adherent deposit formations of wax.

More specifically, a ring plug, or "packer", can be inserted in the annular space between the production tube and the oil string casing just above the oil extraction zone. Another ring plug, or "packer", can be installed in the annular space further up in the well beyond the region where the deposition of the wax onto the inner surface of the production tube normally ceases. A fluid of favorable liquifaction and vaporization temperatures at convenient pressures can be introduced into the space between the ring plugs in the annular space between the production tube and the oil string casing at such a pressure that at the higher temperatures at the base of the well the fluid vaporizes and rises convectively to the wax deposition zone where it condenses and drops back with the normal heat of condensation being used to warm the exterior surface of the production tube. The outer surface of the production tube acts as a condenser in areas where wax build-up has occurred since such deposits form and persist creating areas slightly cooler than uncoated regions of the tube. Thus, such areas will selectively receive heat from condensation of the working medium which will, therefore, provide heat when it is required to melt the wax at the tube interface while minimizing loss of heat elsewhere. Since the amount of heat necessary to melt an interface layer of wax is limited, it is possible to extract these few BTU's needed from the surfaces of the production tube and casing at depths where sufficient temperatures exists to prevent deposition of wax in such deposition zone.

The working medium used in the thermal syphon system of this invention may be any of the well-known materials having temperatures of vaporization from about 100° F. to about 400° F. over the pressure range of about 0.10 to 10 atmospheres. Moreover, such a medium must be compatible with steel, concrete and oil field sealing materials. Also, the medium must be inexpensive, possess long-term stability, present few problems of toxicity, and must be inactive in the presence of petroleum products. Suitable materials for the working medium include inorganic materials such as ammonia and substituted amines; alcohols such as methyl alcohol, ethyl alcohol and other lower alcohols; ketones, such as acetone; aldehydes such as formaldehyde and acetaldehyde; saturated hydrocarbons such as propane, pentane, heptane, hexane, and octane; halogenated hydrocarbons such as dichlorodifluoromethane (freon); cyclic ring compounds such as cyclobutane, cyclopentane, cycloheptane and cyclohexane; and ring compounds such as benzenes, xylenes and naphthalenes. The listed working medium materials may be substituted as long as the working medium remains within the indicated working parameters. Also, mixtures of one or more of the indicated working medium materials may be used if desired. Pentane is a preferred working medium because the temperature and pressure requirements needed for heating the outer surface of the inner well casing are easy to handle, it is compatible with oil well materials, it is cheap and stable, and its heat transfer properties and density are adequate.

DETAILED DESCRIPTION OF THE INVENTION

Turning now to FIG. 1, earth formations 10 are penetrated by a borehole leading from the surface of the earth to an oil-producing formation. The borehole is lined by steel casing 12 which is cemented into place by cement 14. It will be understood by those skilled in the art that several layers of steel casing and cement may be concentrically around the borehole at the surface depending upon the depth of the well and the drilling procedure used.

Concentric within the steel casing 12 is a production tube 16 which extends from the surface of the earth to the oil-producing formation. Oil produced by the well enters the production tube 16 from the oil-producing formation and is allowed to flow or is pumped to the surface through the central bore through the production tube 16 as is known in the art.

An upper plug or packer 18 and a lower plug or packer 20 is provided in the annulus between casing 12 and production tube 16 to isolate a portion 26 of the annulus.

A working fluid pipe 22 and a clean-out pipe 24 are provided through the upper packer 18 and extend from the surface through the packer 18 into the annulus portion 26. The working fluid pipe 22 extends to just below the upper packer 18, while the clean-out pipe 24 extends into the annulus portion 26 to a point just above the lower packer 20.

Annulus portion 26 is divided into a lower, evaporation region 28 and an upper, condensation region 30. Upper packer 18 is positioned to be just above the area 32 from which wax is to be removed. It can thus be seen that region 32 to be cleaned is on the opposite wall of the production tube 16 from the condensation region 30 of the annulus portion 26.

In operation, when a new well or a reconditioned well is ready to be put into production, a production string with upper packer 18 and lower packer 20 appropriately positioned is lowered into place. It will be understood that the packers 18 and 20 may be any of the known production type packers or wire line set packers such as are known in the art. The location of the upper packer 18 will be controlled by the location of the area 32 from which the formation of wax is to be prevented. This location may be determined from prior experience with the subject well or from theoretical calculations. The length of annulus region 26 may then be determined by the temperature gradient of the well and the temperature of the working fluid needed to provide adequate evaporation and condensation to transfer heat from the evaporation region 28 to the condensation region 30 of annulus portion 26. Based on these criteria, the location of lower packer 20 is determined.

After the production string including packers 18 and 20, production tube 16, and pipes 22 and 24 is in place, the working fluid is then transferred from the surface through working fluid pipe 22 to annulus region 26.

It is a common practice to fill the annulus between the production tube 16 and the casing 12 with a liquid such as sea water, salt water, fresh water, drilling fluid or in some cases a hydrocarbon. It will thus be understood that any liquid present in the well between the production tube 16 and the well casing 12 will likewise be trapped between packers 18 and 20. This fluid is circulated out of annulus portion 26 by introducing an inert gas such as nitrogen through working fluid pipe 22 until all unwanted fluid in the annulus portion 26 has been expelled through clean-out pipe 24. The annulus is then evacuated and a working fluid such as pentane or other fluid disclosed herein may then be placed in annulus portion 26 through either pipe 22 or 24. After the correct volume of working fluid has been placed in annulus portion 26, clean-out pipe 24 is closed in. The pressure in the annulus portion 26 is then either increased or decreased until the critical pressure is reached for the temperature to cause boiling at region 32 and condensation in region 30 to release heat to tubing 16.

Working fluid pipe 32 is then closed in. The working fluid in evaporation region 28 will evaporate or boil due to the heat present in the borehole at the lower elevation. The vapor from the working fluid due to this evaporation will rise to condensation region 30. The pressure in region 30 is monitored through working fluid pipe 22 such as by pressure gage 34 for maintaining conditions in condensation region 30 at the dew point for the working fluid used so that the working fluid condenses on the walls of the production tube 16 thereby releasing heat. The condensed working fluid then runs down the walls of tubing 16 and casing 12 to evaporation region 28. The heat released due to the condensation of working fluid on the walls of production tubing 16 is sufficient to raise the temperature at region 32 to prevent the formation of wax, or if it has formed, to melt the interface between the wax and the inner walls of production tubing 16. Crude oil being produced through production tubing 16 will then flush out and scour wax from tubing 16.

Figure 2:
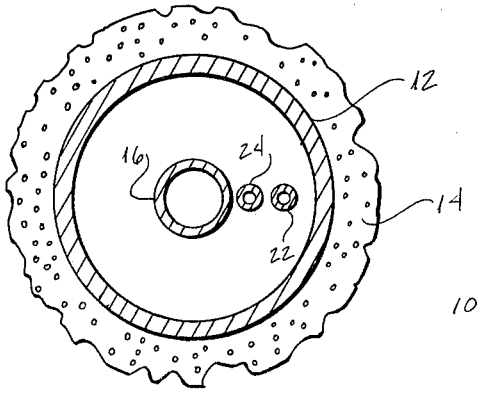
FIG. 2 is a top view of FIG. 1 taken along section line 2—2.

FIG. 2 is a top view of the well showing well casing 12 cemented into place by cement 14 in an earth formation 10.

In some installations, much of the heat transferred by the vapor of the working medium may be deposited on the inner surface of casing 12 and still assist in heating region 32 because heat transfer from casing 12 to the surrounding ground is restricted by cement, earth, rock, or other insulation. As a result the inner surface of casing 12 in region 30 is heated, raising its temperature, and thus further limiting temperature drop of the production tube surface 32 in region 30 by reducing radiation and convection.

Again, it will be understood that the well casing 12 and cement 14 may actually be a series of concentric layers of casing and cement depending upon the physical configuration of the well in which the invention is used. Production tube 16 is shown concentrically located within casing 12. Working fluid pipe 22 and clean-out pipe 24 are located in the annulus between production tube 16 and well casing 12. In addition to the configuration shown in FIGS. 1 and 2, pipes 22 and 24 may be connected to an appropriate by-pass sub comprising concentric tubing for by-passing upper packer 18 allowing a conventional packer to be used.

EXAMPLE

The preferred working fluid of the present invention is pentane or heptane. The most preferred working fluid is pentane because of its vapor specific volume at the temperature encountered in oil wells for which the invention is intended. Also, at these temperatures, the saturation pressures to be maintained in condensation region 30 are most advantageous.

In Van der Waals equation of state:

$$(P+(n^2a)/v^2)(v-nb)=nRT$$

where:

P=saturation pressure in atmosphere,
n=moles,
v=volume in liters,
T=saturation temperatures in degrees absolute,
R=0.08205 liter atmosphere per degree per mole,
a=a constant in liter atmosphere per mole, (19.01 for pentane), and
b=a constant in liters per mole (0.1460 for pentane).

Thus, knowing the temperature range of interest, the saturation pressures can be determined. Table I is a tabulation of the temperature, pressure and latent heat at selected temperatures for pentane.

TABLE I

| Temp. C.° | Temp. F.° | Saturation Pressure PSIA | Latent Heat BTU/lb |
|---|---|---|---|
| 20 | 68 | 11.02 | 157.81 |
| 40 | 104 | 22.04 | 152.91 |
| 60 | 140 | 33.06 | 147.23 |
| 80 | 176 | 56.41 | 141.55 |
| 100 | 212 | 104.26 | 128.19 |

In a typical well, the steel casing 12 has a 7 inch inner diameter; the production tube 16 has a 2 inch inner diameter and a wall thickness of 0.25 inches. The cross sectional area of the annulus portion 26 between the casing 12 and the production tube 16 is 0.233 square feet. The thickness of the concrete for the present example is 2 inches.

For the present example, the temperature of the oil flowing in production tube 16 through the evaporation region 28 is 145° F., the temperature of the earth just below the deposit zone 32 is 80° F., the initial temperature of the working fluid in annulus portion 26 is 143° F., and the temperature of solidified wax on the walls of production tube 16 in zone 32 is 140° F. The packers 18 and 20 are spaced 1000 feet apart to make the length of the thermal siphon 1000 feet. The heat siphon of the invention supplies enough heat to melt 10 pounds of wax per hour along the interface of the wax and the steel of the production tube 16 in zone 32. The latent heat of fusion of wax is 100 BTU per pound, making a total of 1000 BTU's per hour that the heat siphon of the invention must supply. Table II is a tabulation of the temperature saturation pressure, vapor specific volume and liquid density of pentane in the temperature range of the well of the example.

TABLE II

| Temp. °F. | Saturation Pressure PSIA | Vapor Specific Volume ft.$^3$/lb | Liquid Density lb/ft$^3$ |
|---|---|---|---|
| 135 | 31 | 2.62 | 36.8 |
| 138 | 32 | 2.55 | |
| 140 | 33 | 2.49 | 36.6 |
| 142 | 34 | 2.42 | |
| 145 | 35.5 | 2.35 | 36.4 |
| 148 | 37 | 2.23 | |
| 150 | 38.4 | 2.20 | 36.1 |
| 152 | 40 | 2.13 | |
| 155 | 42 | 2.06 | |

The heat distribution per unit of pipe surface in the condensation region 30 is:

$$\text{heat-to-earth} = (T_i - T_e)(K_c)/t_c$$
$$= (143 - 80)(5)/2 = 157.5 \text{ BTU per hour,}$$

where:

$T_i$=initial temperature of the working fluid
$T_e$=temperature of the earth
$K_c$=conductivity of concrete (5 BTU inch per hour per °F. per square feet), and
$t_c$=thickness of concrete 14 to the earth 10.

$$\text{Heat-to-wax} = (T_i - T_w)(K_s)/t_s$$
$$= (143 - 140)(360)/0.25$$
$$= 4320 \text{ BTU per hour}$$

where:

$T_i$=initial temperature of the working fluid
$T_w$=temperature of solidified wax in deposit zone 32.
$K_s$=conductivity of steel (360 BTU inches per hour per °F. per square foot) and,
$t_s$=thickness of steel production tube 16.

The ratio of heat-to-wax over heat-to-earth is 4320/157.5 or 27.4 which means that about 27 times the heat released to the earth 10 is released to the production tube 16. This means that the heat loss to the earth surrounding the thermal siphon is not excessive, but rather is low enough to maintain the inner surface of the casing 12 at a favorable temperature with relatively negligible heat loss.

The length of condensation region 30 needed to supply 1000 BTU's per hour is calculated by:

$$BTU_w=(K_s/t_s)(A_c)(T_i-T_w)$$

where:

$BTU_w$=BTU's needed to melt 10 lbs. of wax per hour (1000), $K_s$=conductivity of steel (360 BTU inches per hour per °F. per square foot), $t_s$=thickness of production tube 16, $A_c$ = area of condensation region 30 for transferring heat, $= \pi dL = 0.5236L$, where $d$ and $L$ are in feet, $T_i$=initial temperature of the working fluid, and $T_w$=temperature of the solidified wax. then:

$$1000 = (360/.25)(0.5236L)(143 - 140), \text{ or}$$
$$L = (1000)/((360/.25)(0.5236)(3))$$
$$= 0.442 \text{ feet.}$$

The length of the evaporation region 28 needed to transfer heat from the oil at the hotter depths of the well to the working fluid can be calculated by:

$$BTU_w=(K_s/t_s)(A_c)(T_o-T_i)$$

where:

$BTU_w$=BTU's needed to melt 10 lbs. of wax per hour (1000), $K_s$=conductivity of steel (360 BTU inches per hour per °F. per square foot), $t_s$=thickness of production tube 16, $A_c$=area of evaporation region 28 for transferring heat, $=\pi dL=0.5236L$, where d and L are in feet, $T_o$=the temperature of the oil at the depth of the evaporation region 28, and $T_i$=initial temperature of the working fluid. thus:

$$1000 = (360/.25)(0.5236L)(145 - 143), \text{ or}$$
$$L = (1000)/((360/.25)(0.5236)(2))$$
$$= 0.663 \text{ feet.}$$

It can thus be seen that to melt 10 pounds of wax per hour at the temperature indicated, the evaporation region 28 must be at least 0.663 feet long and the condensation region 30 must be at least 0.442 feet long. Since the total length of the siphon is 1000 feet these requirements are easily met.

It is known that the critical flux for pentane nucleate boiling is 72,900 BTU per square foot per hour ±50%. If the flux is higher than this amount, film boiling occurs and the heat transfer characteristics of the pentane is seriously affected. A length of 20 feet for the evaporation region 28 results in the heat transfer area being equals to 0.5236×20 or 10.47 square feet. The specific heat flux to melt 10 pounds of wax per hour is 1000 BTU per hour transferred through the 10.47 square feet of the evaporation region 28. This equals 1000 BTU per hour/10.47 $ft^2$ or 95 BTU per square foot per hour. This is far below the point at which pentane changes from nucleate boiling to film boiling. To achieve a critical flux of 72,900 BTU per square foot per hour, the evaporator would have to be less than 0.026 feet long. This can be calculated by:

$$(72{,}900)/(1) = (1000)/(0.5236L), \text{ or}$$
$$L = 1000/(72{,}900 \times 0.5236)$$
$$= 0.026 \text{ feet.}$$

This is less than the evaporation region length of 0.664 ft for the temperatures of the example. Thus, the evaporation region length is well over the critical length needed to maintain nucleate boiling of the pentane.

Referring to Table I, the latent heat of pentane at 140° F. is 147.23 BTU per lb. This requires the vaporization of 1000/147.23 or 6.79 lbs of pentane per hour. Also shown in Table II, the specific volume of pentane vapor at 140° F. is 2.49 cubic feet per lb. This requires a mass flow of (6.79 lbs/hr)×(2.488 $ft^3$/lbs) or 16.89 $ft^3$/hr. The cross sectional area of the annulus portion 26 is 0.233 $ft^2$. Thus, the velocity of the pentane is (16.89 $ft^3$/hr)/(0.233 $ft^2$) or 72.49 ft/hr or 0.02 ft/sec. All of these values are within reasonable ranges.

The mass of pentane required for an assumed siphon length of 1000 ft and an evaporation region length of L feet is shown in Table III.

TABLE III

| Evaporator Length L Ft. | Evaporator Volume Cubic Ft. | At 140° F. Pentane Charge in lbs | | |
|---|---|---|---|---|
| | | Liquid | Vapor | Total |
| 10 | 2.33 | 85.28 | 92.64 | 177.92 |
| 20 | 4.66 | 170.56 | 91.70 | 262.26 |
| 40 | 9.32 | 341.11 | 89.83 | 430.94 |
| 80 | 18.64 | 682.22 | 86.09 | 768.31 |

Thus, in the present example 262.26 pounds of pentane is placed into annulus portion 26 and the pressure is maintained at 33 PSIA through working tube 22. Then pentane would reach equilibrium having an evaporation region length of 20 ft with 170.56 pounds of liquid and 91.70 pounds of vapor in the heat siphon of the invention.

With the lowest 100 ft. of the annulus portion 26 occupied by liquid, a liquid volume of 22.3 cubic feet is provided. The upper 900 feet are occupied by vapor having a volume of 200.7 cubic feet. For this configuration, the thermal siphon of the invention requires 816.18 pounds of liquid and 80.60 pounds of vapor for a total of 869.78 pounds at 140° F. If the temperature rises in the annulus from an initial value of 140° F. to 150° F., the vapor pressure, remaining saturated, will rise from 33 to 38.4 PSIA and the vapor specific volume will drop from 2.49 to 2.20 cubic feet per pound (see Table II).

It will be understood that small temperature increases will cause a rise of pressure in the annulus portion 26 and an increase in liquid level which causes an increase in the evaporation region heat transfer surface slightly increasing vapor generation. This will be balanced by a reduction in condenser action with the rise in temperature. If the excursion is in the reverse direction and the temperature drops, the liquid level will drop. The drop will be counter-balanced by more effective condenser action of this heat siphon of the invention. In most cases condensation action can be maintained as desired by changing the pressure in the annulus portion 26 responsive to temperature sensed through working fluid pipe 22.

In the event of substantial temperature excursions which cannot be compensated for by pressure changes to the annulus portion 26, system equilibrium is maintained by a closed loop control system. This involves connection of a pressurized pure pentane container 40 to one of the clean out pipe 24 or working fluid pipe 22 through control a valve 42 and pump 44 capable of admitting or removing a measured amount of pentane from the annulus portion 26 responsive to temperature of pressure sensed as through a probe 46 in the annulus portion 26 through working fluid pipe 22 whose measurements are transmitted over a transmitting means 48 to the surface of the earth.

Thus, there has been shown and described novel means for controlling wax formation in oil wells using a thermal syphon system. It will be apparent to those skilled in the art, however, that many changes, modifications, variations, and other uses and applications for the subject means are possible and contemplated, and all such changes, modifications, variations, and other uses and applications which do not depart from the spirit and scope of the invention are deemed to be covered by the invention which is limited only by the claims which follow.

What is claimed is:

1. A method for preventing the accumulation of solid substances on the inner surface of an oil well production tube in an oil well through which crude oil is removed from below the surface of the earth comprising isolating from the well fluids a portion of the oil well annulus between the production tube and the walls of the oil well, disposing a working medium in the isolated portion of the oil well annulus around the production tube, providing contact between the lower portion of the working medium and the walls of the oil well for heating the working medium, providing a flow passage for the heated working medium to rise in the oil well for heating the outer surface of said oil well production tube where the solid substances are known to solidify and deposit on said inner surface just enough to reliquify a thin film of said solid substance immediately adjacent said inner surface of said oil well production tube so that the force of the upward flow of said crude oil as it is removed from below the surface of the earth will remove said solid substances along with said crude oil and thus prevent accumulation of said solid substances on the inner surface of said oil well production tube.

2. A method according to claim 1 wherein disposing the working medium in the oil well includes disposing the working medium in a fluid composition having workable physical characteristics of vaporization, liquifaction, density, heat transfer, pressure and compatibility.

3. The method according to claim 2 wherein disposing the working medium in the oil well includes disposing the working medium in a fluid composition selected from the group consisting of pentane, heptane, hexane, and octane.

4. The method according to claim 3 wherein disposing the working medium in the oil well includes disposing the working medium in a fluid composition including pentane.

5. A method for maintaining continuous, uniform, free flow of wax-laden crude oil in a well structure having an elongated vertical well production tube extending downward from ground level to a production zone, said production tube being surrounded by an outer elongated vertical well casing extending downward from ground level through a point at which wax is known to solidify in the crude oil to a point at which said wax does not solidify in the wax-laden crude oil, said method comprising placing an annular plug in the annular space between said inner vertical well production tube and said outer vertical well casing below the point at which wax is known to solidify in the crude oil in order to plug the annular space between said inner well casing and said outer well casing, placing a plug in the annular space between said inner well production tube and said outer well casing at a point above which wax is know to solidify in the crude oil, providing a pipe through said upper annular plug into said annular space and charging a working medium through said pipe into the annular space between said inner well extraction tube and said outer well casing in sufficient quantity and at appropriate pressure to provide the heat transfer required to prevent solidification of wax from the wax-laden crude oil in the well production tube.

6. An oil well structure comprised of an inner tubing extending from above the surface of the earth down into the crude-oil bearing strata inside the earth and an outer casing extending from above the surface of the earth down into the earth to a point at which solid substances do not separate from said crude oil and do not deposit on the inner surface of said inner casing, said outer casing being slightly removed from said inner tubing to provide an annular space between said inner tubing and said outer casing, means on top of said inner tubing for removing the crude oil, means for plugging said annular opening between said inner tubing and said outer casing at said point at which solid substances do not separate from said crude oil, means for plugging said annular opening between said inner tubing and said outer casing at a point above where said solids are known to deposit onto the inner surface of said inner tubing, said annular opening containing a working fluid having known physical characteristics of conversion from gas to liquid and back to gas being contained within said annular opening, said upper plugging means having means through which annulus fluid can be extracted and a working fluid can be injected into the annular opening and removed from said annular opening as required to maintain appropriate pressures.

7. In an oil well having a borehole extending from the surface of the earth to a subterranean oil bearing formation, a casing lining the walls of said borehole, and a production tubing in said casing extending from the surface of the earth to the oil bearing formation for extracting well fluid through the production tubing, said oil well having a temperature gradient extending from the surface of the earth to the oil bearing formation, and a well annulus between said production tubing and said well casing having a zone wherein a component of the well fluid solidifies on the inner wall of the production tubing; a thermal syphon comprising: an upper packer in said well annulus positioned above said zone for forming a pressure seal in said well annulus between the well annulus above said upper packer and said zone below said upper packer; a lower packer in said well annulus positioned below said zone for forming a pressure seal between the well annulus below said lower packer and said zone above said lower packer; and, a working fluid in said well annulus between said upper and lower packers, said working fluid having its boiling point lower that the temperature and pressure present in the lower portion of said well annulus intermediate said packers and its condensation point at the temperature and pressure present in said zone for heating said production tubing in said zone by the action of said working fluid boiling in the lower portion of said well annulus between said packers and condensing in said zone, wherein said heating prevents the build up of said well fluid component on the inner wall of said production tubing.

8. An oil well thermal syphon according to claim 7 further comprising a first pipe in said well annulus extending from the surface of the earth through said upper packer for charging said working fluid into the well annulus between said upper and said lower packers.

9. An oil well thermal syphon according to claim 8 further comprising a second pipe in said well annulus extending from the surface of the earth through said upper packer and into the lower portion of the well annulus between said upper and lower packers for removing fluid in said well annulus between said upper and said lower packers.

10. An oil well thermal syphon according to claim 9 further comprising sensing means in said zone of said well annulus for sensing at least one of temperature and pressure, and transmitting means extending from the surface of the earth to said sensing means through one of said first and said second pipes for transmitting measurements from said sensing means to the surface of the earth.

11. An oil well thermal syphon according to claim 10 further comprising pressure changing means connected to one of said first and said second pipes for changing the pressure in said well annulus zone responsive to measurements of said sensing means transmitted from said well annulus zone over said transmitting means.

12. An oil well thermal syphon according to claim 11 comprising control means connected to one of said first and said second pipes for changing the amount of working fluid in said well annulus between said packers responsive to measurements of said sensing means transmitted from said well annulus zone over said transmitting means.

13. An oil well thermal syphon according to claim 9 further comprising pressure measuring means at the surface for measuring the pressure in at least one of said first and second pipes.

14. An oil well thermal syphon according to claim 7 wherein said working fluid is pentane.

* * * * *

UNITED STATES PATENT AND TRADEMARK OFFICE

CERTIFICATE OF CORRECTION

PATENT NO. : 4,328,865

DATED : May 11, 1982

INVENTOR(S) : Edward N. Hall

It is certified that error appears in the above—identified patent and that said Letters Patent is hereby corrected as shown below:

Column 3, line 11, "temperatures" should read -- temperature --.

Signed and Sealed this

*Twenty-fourth* Day of *August 1982*

[SEAL]

*Attest:*

GERALD J. MOSSINGHOFF

*Attesting Officer*

*Commissioner of Patents and Trademarks*